US005956908A

United States Patent [19]

Bitschnau et al.

[11] Patent Number: 5,956,908

[45] Date of Patent: Sep. 28, 1999

[54] CONCRETE CONTAINER

[75] Inventors: Lothar Bitschnau; Harald Bitschnau, both of Bartholomäberg, Austria

[73] Assignee: MST-Bau GmbH, Bludenz, Austria

[21] Appl. No.: 08/932,026

[22] Filed: Sep. 17, 1997

[30] Foreign Application Priority Data

Sep. 23, 1996 [AT] Austria ..... A 1682/96

[51] Int. Cl.[6] ..... E04H 7/00

[52] U.S. Cl. ..... 52/197; 52/194; 52/195; 198/532; 220/260; 220/331; 222/185.1; 222/528; 222/529; 222/531; 414/299

[58] Field of Search ..... 52/192, 193, 194, 52/195, 197, 749.1, 749.13; 193/2 R, 25 R, 25 S, 4, 2 C, 16, 20, 21, 32; 138/119; 198/532; 414/299; 222/185.1, 528, 529, 531; 220/260, 331; 298/27; 406/196

[56] References Cited

U.S. PATENT DOCUMENTS

| | | | |
|---|---|---|---|
| 835,595 | 11/1906 | Bishop | 222/502 |
| 1,080,514 | 2/1913 | Kneeland | 222/531 X |
| 2,507,873 | 5/1950 | Ward | 198/532 X |
| 2,616,758 | 11/1952 | Meyers | 222/529 X |
| 2,652,222 | 9/1953 | McCowan | 222/529 X |
| 2,681,751 | 6/1954 | Stone et al. | 222/185.1 X |
| 2,821,433 | 1/1958 | Hamlet | 193/25 R |
| 3,101,871 | 8/1963 | Lucas et al. | 222/185.1 |
| 3,850,349 | 11/1974 | Pirovano | 222/529 |
| 4,460,110 | 7/1984 | Helander | 222/504 |
| 5,105,981 | 4/1992 | Gehman | 222/185.1 X |
| 5,257,893 | 11/1993 | Sevits | 222/529 |
| 5,494,189 | 2/1996 | De Crane | 222/529 |

FOREIGN PATENT DOCUMENTS

| | | |
|---|---|---|
| 395742 | 7/1992 | Austria . |
| 399010 | 7/1994 | Austria . |
| 2359262 | 2/1978 | France . |
| 146985 | 3/1981 | Germany . |
| 3310176 | 9/1983 | Germany . |

*Primary Examiner*—Carl D. Friedman
*Assistant Examiner*—Laura A. Callo
*Attorney, Agent, or Firm*—Friedrich Kueffner

[57] ABSTRACT

A concrete container for introducing concrete into formworks includes an upwardly open vessel with a downwardly narrowing bottom portion with an outlet opening and a flexible pipe connected to the outlet opening for distributing the concrete. Underneath the outlet opening of the concrete container, an essentially horizontally extending crossbeam is arranged, wherein the crossbeam is arranged so as to be displaceable transversely of the freely suspended flexible pipe. The two ends of the crossbeam, whose length corresponds at least to the diameter of the flexible pipe, are suspended from the concrete container by connecting members. Tension springs are attached in an articulated manner to the two ends of the crossbeam, wherein the other ends of the tension springs are fastened to the support frame, wherein the tension springs are tensioned when the crossbeam is located laterally of the outlet opening in a position releasing the flexible pipe. An adjusting member is connected in an articulated manner to the crossbeam, wherein the other end of the adjusting member is connected to the support frame of the concrete container, wherein the adjusting member serves to move the crossbeam against the force of the tension springs transversely of the flexible pipe.

4 Claims, 3 Drawing Sheets

CONCRETE CONTAINER

BACKGROUND OF THE INVENTION

1. Field of the Invention

The present invention relates to a concrete container for introducing concrete into formworks. The concrete container includes an upwardly open vessel with a downwardly narrowing bottom portion with an outlet opening and a flexible pipe, particularly a hose, connected to the outlet opening for distributing the concrete. The vessel and/or a support frame supporting the vessel include suspension means for suspending the concrete container from a lifting means. Underneath the outlet opening of the concrete container, an essentially horizontally extending crossbeam is arranged, wherein the crossbeam is arranged so as to be displaceable transversely of the freely suspended flexible pipe. The displacement distance of the crossbeam corresponds at least approximately to the diameter of the flexible pipe, wherein, when the crossbeam is displaced, the crossbeam traverses the area underneath the outlet opening and reduces the cross-section of the flexible pipe as a result.

2. Description of the Related Art

In civil engineering, concrete containers are used for filling formworks with concrete when erecting a structure. In the simplest embodiment, this concrete container has an outlet opening with a sliding valve which can be actuated by means of a pivotally mounted lever. The concrete container suspended from a lifting means is moved laterally against a concrete transporting vehicle and is filled with concrete through a chute. The concrete container filled in this manner is then lifted by the lifting means and is moved to the location where the concrete is to be introduced into the formwork. An operator placed at this location actuates the lever for opening the sliding valve and the concrete slides as a result of its own weight through the outlet opening into the formwork. After the concrete container has been emptied in this manner, the sliding valve is again closed by means of the afore-mentioned lever and the concrete container is subsequently returned by means of the lifting means to the concrete transporting vehicle, where the container is filled again. Concrete containers of this type have been found very useful in the case of those formworks in which the upper rim is freely accessible. This is usually the case in formworks as they are used in the construction of houses and apartment buildings.

However, the accessibility of the formwork is significantly impaired if the formwork is constructed as a sliding formwork, as it is preferably used when erecting tower-like structures. Such a formwork is shown, for example, in Austrian patent application A 634/91, published Jul. 15, 1992. In that case, the formworks or formwork sections are suspended from support yokes, which, as a rule, support work platforms on both sides of the structure to be erected and, of course, the formwork itself. Moreover, reinforcing iron members arranged closely next to each other protrude upwardly to a significant extent, as shown on the coversheet of "Beton- und Stahlbetonbau" [concrete and reinforced concrete construction] Volume 10/92, 87th year.

Concrete containers of the above-described type are no longer capable of filling these sliding formworks because the various structures of the formworks make it impossible for the concrete container to be moved sufficiently close to the rim of the formwork. For this reason, concrete containers of this type have been equipped with a distributing hose, wherein a sliding valve is provided between the hose and the outlet opening of the container. In addition, a platform is attached to the support frame of the concrete container on which an operator is standing whose purpose it is to actuate the sliding valve, wherein a second operator guides the end of the hose, which is usually several meters long, to the filling area of the formwork. Upon instructions by the second operator, the operator on the support platform actuates the sliding valve. Since the use of a sliding formwork for erecting a structure requires that concrete is filled into the formwork continuously, it is necessary that an operator is transported together with this concrete container at all times, wherein the only task of this operator is to open and close the sliding valve upon command of another operator. This manner of operation is not particularly economical.

In order to avoid these problems, in accordance with another development, the sliding valve has been mounted at the outlet end of the distributing hose, so that the operator who guides the hose also operates the sliding valve. In order to ensure that the distributing hoses can reach the formwork rim, they usually have a length of 6 to 7 m and a diameter of about 20 cm. In operation, the distributing hose is fully filled with concrete and, therefore, the distributing hose is very heavy, so that usually two operators are required for handling the end of the distributing hose equipped with the sliding valve. In addition, under the rough conditions as they exist on a construction site, the protruding reinforcing steel members may damage and rip open the distributing hose, which would mean that, in the case of a full concrete container, the contents thereof would drop onto persons standing underneath the concrete container. The contents of the concrete container have a weight of several tons.

In order to overcome this disadvantage, it has been provided in a further development of the construction described above, to provide a pipe piece between the outlet opening of the container and the distributing hose. A motor-driven screw is mounted in this pipe piece. The motor for driving the screw is attached to the container or the support frame for the container. The axial length of the screw is slightly greater than axial length of the pipe piece. Fastened to the upper rim of the container is a crossbeam located in the diameter plane of the container, wherein the motor for the screw is flanged to the middle portion of the crossbeam. The drive shaft extends concentrically through the container. The pipe piece is alignment with the vertical center axis of the container. In this construction known from AT 399 010 B, the flow of the concrete out of the container is controlled by means of the screw. However, this requires that the concrete has a sufficiently firm consistency. If a relatively liquid concrete is being processed, the screw is not sufficient for holding this thin, flowable concrete back reliably.

In order to overcome this disadvantage, it has already been proposed in DD 146 985 A to arrange a closing mechanism underneath the outlet opening. This closing mechanism is composed of elastic sealing members arranged at the longitudinal sides of the outlet opening and an elastic closing sheet stretched from one narrow side to the other narrow side of the opening, wherein the closing sheet is attached to one narrow side and to a roller. The roller has on both sides thereof gears connected to drive shafts, wherein hand wheels are mounted on the drive shafts. The gears engage in racks, wherein compressive rack springs are mounted in the extensions of the racks. These compressive rack springs are arranged in bearing rails, wherein rollers are arranged in the bearing rails underneath the racks. The bearing rails rest on compressive bearing rail springs in the housing, wherein the compressive bearing rail springs are fastened to the middle stiffening plane of the frame. A funnel with the hose is located underneath the closing mechanism.

This closing mechanism is not only of complicated construction, it is also susceptible to trouble to a significant extent because the gears and racks constitute an open gear system which very easily becomes dirty and is blocked under the conditions existing at a construction site.

A mouthpiece for ejecting viscous material disclosed in DE 33 10 176 A1 should also be mentioned in this connection. The mouthpiece includes a contraction valve with a controllable valve body of an elastic material. The mouthpiece includes two pipes of about equal size extending in a common longitudinal direction and a hose of an elastically deformable material for connecting the pipes, wherein the hose can be compressed between the two pipes. An outer pipe is sealingly connected to the two inner pipes by means of funnel-shaped components extending axially relative to the pipes, so that an annular space is created which can be connected to a pressure medium source. A mouthpiece of this type has a significant structural length and, therefore, is not suitable for concrete containers for the reasons already mentioned above.

Finally, the closing mechanism known from FR 2 359 262 A1 must be mentioned. In that case, pairs of spaced-apart tooth segments are arranged underneath the outlet opening of the container, wherein the tooth segments of each pair mesh with each other and one of the pairs can be swung by means of a lever. Several crossbeams can be arranged between the pairs of toothed segments, wherein the center points of the crossbeams are connected on a spiral line. The flexible hose attached to the outlet opening extends between the crossbeams. The hose can be squeezed closed by swinging the toothed segments. This device is of complicated construction and uses a lot of space; in addition, the tooth segments are structural components which are not advantageous under the rough conditions existing at a construction site.

SUMMARY OF THE INVENTION

Therefore, it is the primary object of the present invention to provide a concrete container which avoids the disadvantages of the known concrete containers described above.

In accordance with the present invention, the two ends of the crossbeam, whose length corresponds at least to the diameter of the flexible pipe, are suspended from the concrete container by means of connecting rods, ropes or chains. Tension springs are attached in an articulated manner to the two ends of the crossbeam, wherein the other ends of the tension springs are fastened to the support frame of the concrete container, wherein the tension springs are tensioned when the crossbeam is located laterally of the outlet opening in its position releasing the flexible pipe or the cross-section thereof. An adjusting member is connected in an articulated manner to the crossbeam, preferably in the middle portion thereof, wherein the other end of the adjusting member is connected to the support frame of the concrete container, wherein the adjusting member serves to move the crossbeam against the force of the tension springs.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
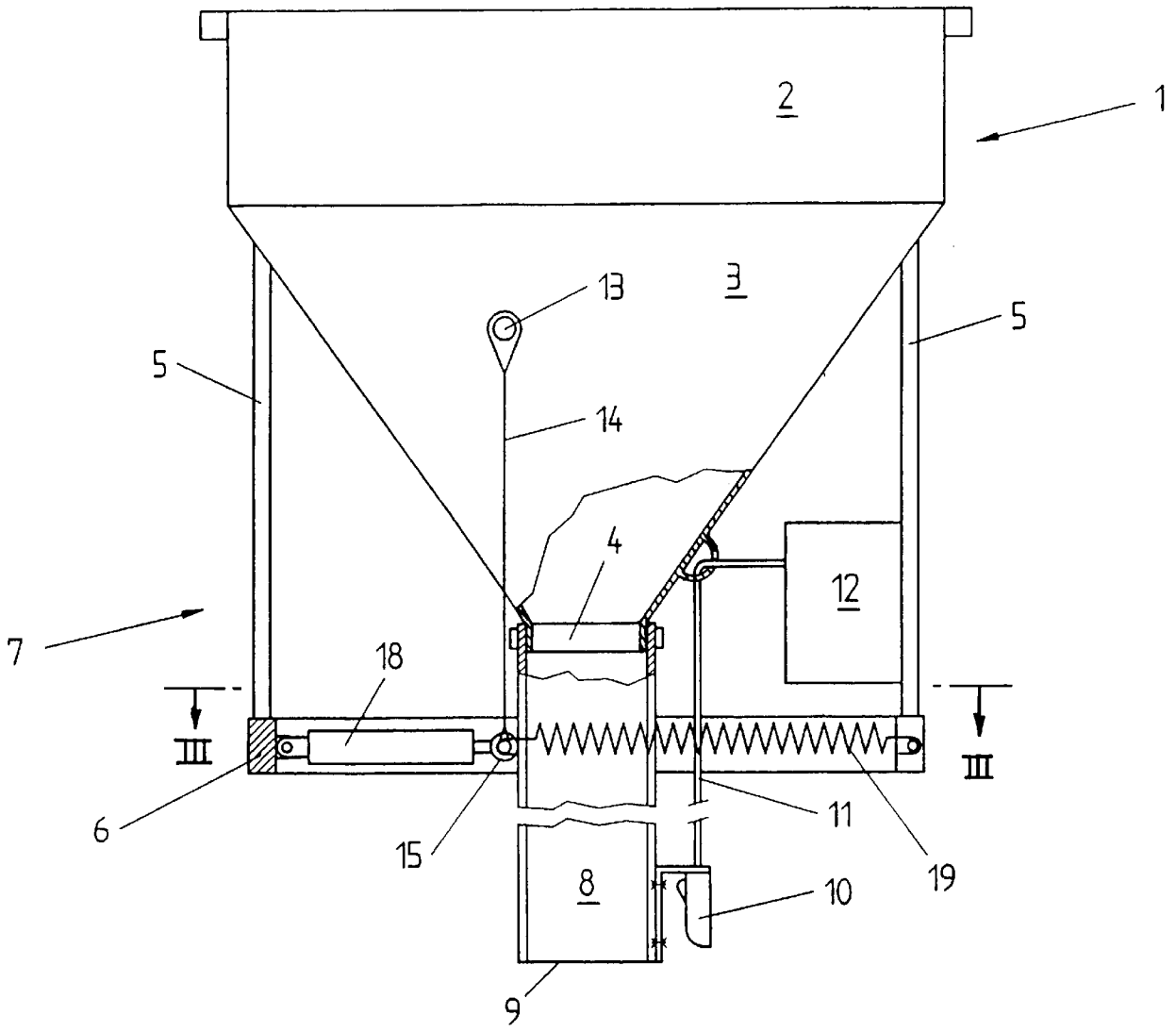
FIG. 1 is a side view of the concrete container according to the present invention.
Figure 2:
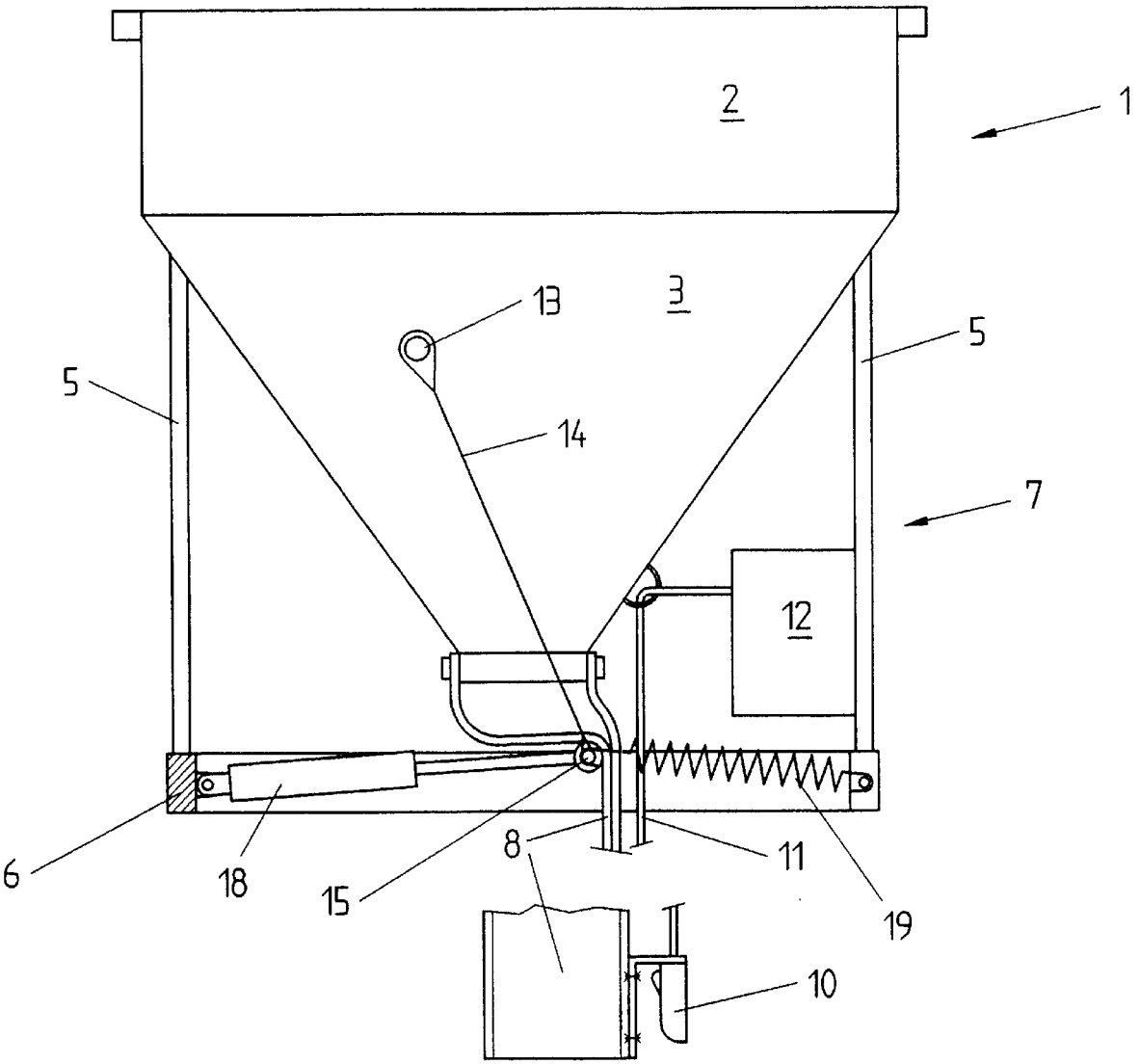
FIG. 2 is a side view, similar to FIG. 1, with the crossbeam being shown in the position in which it is moved against the flexible pipe and reduces the cross-section of the flexible pipe.
Figure 3:
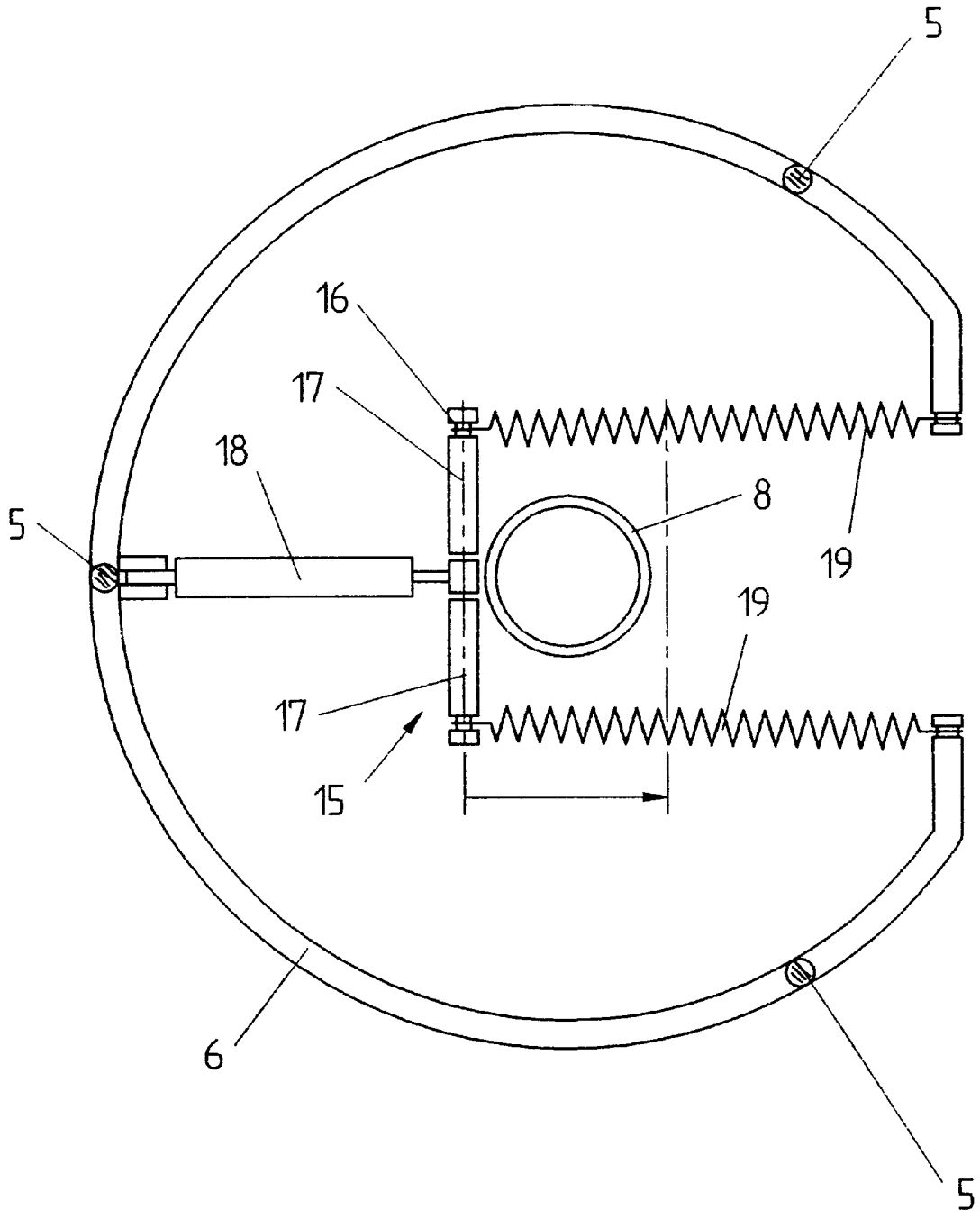
FIG. 3 is a horizontal sectional view taken along sectional line III—III in FIG. 1.

As shown in FIGS. 1 and 2 of the drawing, the concrete container 1 has an upper cylindrical portion 2 and a conical portion 3 contiguous with the bottom side of the cylindrical portion 2. The conical portion 3 ends at the bottom in an outlet opening 4. A support frame 7 receiving the concrete container 1 or fixedly connected to the concrete container 1 is formed by vertical struts 5 whose bottom ends are fastened in an open ring 6. A flexible pipe 8, preferably a rubber-elastic hose, is attached to the outlet opening 4. The flexible pipe 8 may have a length of several meters. At the lower end opening 9 of the flexible pipe 8, a control panel 10 is arranged which is connected through a line 11 to a drive unit 12, which, in turn, is supported by the support frame 7.

Fastening bolts 13 are provided on the concrete container 1 at two diametrically oppositely located locations. Connecting members 14 in the form of steel ropes, chains or the like are suspended from the fastening bolts 13. The lower ends of the connecting members are attached to a crossbeam 15. This crossbeam 15 is composed of a shaft 16 with freely rotatable rollers 17 mounted on the shaft 16. This crossbeam 15 is located slightly underneath the outlet opening 4, preferably in the plane of the open ring 6. An adjusting member 18 is connected to the middle portion of the crossbeam 5, wherein the other end of the adjusting member 18 is connected to the open ring. The adjusting member 18 may be constructed as a piston/cylinder unit or as a mechanical component, such as a threaded gear system, threaded rod, gear wheel system or the like. In addition, tension springs 19 are attached to both ends of the crossbeam 15. The other ends of the tension springs 19 are attached to portions of the open ring 6 which face each other.

FIG. 1 of the drawing shows the position of the crossbeam 15 in which the cross-section of the hose is released or open. The tension springs 19 are tensioned and the adjusting member 18, constructed as a piston/cylinder unit in the illustrated embodiment, is actuated. If the hose 8 is to be closed for filling the concrete container 1 or for transporting the concrete container 1, the adjusting member 18 is deactivated and the force of the tensioned tension springs 19 pulls the crossbeam 15 toward the right as shown in FIG. 1, which causes the hose 8 to be deformed in the manner illustrated in FIG. 2, i.e., the cross-section thereof is decreased until it is closed.

The position of the crossbeam 15 shown in FIG. 2 is assumed when the concrete container 1 is filled or is being transported by means of a lifting means. The force of the springs 19 holds the crossbeam 15 in its closing position because no energy supply exists during the filling or transport of the concrete container. When the concrete container 1 is to be emptied, the adjusting member 18 is actuated and pulls the crossbeam 15 against the force of the springs 19 toward the left as shown in FIG. 1, so that the hose 8 is freely suspended from the outlet opening 4 and its cross-section is fully open and the concrete in the container can flow downwardly through the hose. The tension springs 19 are now again pretensioned. The rollers 17 on the crossbeam 15 prevent that friction occurs relative to the hose 8. The connecting members 14 hold the crossbeam 15 in its position of operation and prevent the articulated system from hanging down and, in addition, they reduce the load acting on the closed hose 8 as a result of the weight of the concrete above the hose 8. Moreover, the connecting members 14 cause the crossbeam 15 to travel on an arc-shaped path between the closing and open positions, which advantageously influences folding and closing of the hose 8.

The drive unit 12, which actuates the adjusting member 18, can be supplied with electric energy either through supply cables or by means of batteries and accumulators. Other forms of energy, for example, compressed air can also be used. Instead of using a switch panel, the drive unit 12 can also be controlled though remote control.

The configuration according to the present invention makes it possible that no mechanical parts come into contact with fresh concrete. The closing mechanism is essentially maintenance-free and protected against contamination by the concrete. Since the closing mechanism is constructed in such a way that no movable parts come into contact with the fresh concrete, it is possible to distribute relatively thin concrete without any concrete slurry dripping out. If a removable switch is mounted at the lower end of the hose 8, or if the concrete container is controlled by remote control, the hose 8 or its bottom end can be lowered into wall formworks or climbing formwork systems.

The invention described above can also be advantageously utilized in those concrete containers which are additionally equipped with a screw, as disclosed in AT 399 010. It is also possible to arrange on the concrete container underneath its outlet opening 4 an abutment which is stationary relative to the concrete container, wherein the flexible hose 8 can be placed against the abutment when its cross-section is reduced or closed by the crossbeam 15 placed against the hose 8, as shown in FIG. 1. However, tests carried out thus far have shown that such an abutment is not absolutely required.

The mechanical tension springs 19 ensure that the hose 8 remains closed if no external energy supply is available. It is basically possible, instead of such mechanical tension springs, to use other structural components which have a comparable effect or which may possibly be actuated by external energy supply.

Instead of using a straight crossbeam, as described above and shown in the drawing, the crossbeam may also be arc-shaped or also loop-shaped or ring-shaped. The adjusting members provided for displacing the crossbeam underneath the outlet opening 4 are then connected in a suitable manner to the crossbeam. In that case, the diameter of the loop or ring is slightly greater than the external diameter of the hose 8, so that the hose can be freely suspended through the loop or ring.

The invention is not limited by the embodiments described above which are presented as examples only but can be modified in various ways within the scope of protection defined by the appended patent claims.

We claim:

1. In a concrete container for introducing concrete into formworks, the concrete container including an upwardly open vessel with a downwardly narrowing bottom portion having an outlet opening, and a freely suspended flexible pipe having a diameter connected to the outlet opening, a support frame for supporting the vessel, one of the vessel and the support frame including suspension means for suspending the concrete container from a lifting means, an essentially horizontally extending crossbeam having two ends arranged underneath the outlet opening so as to be displaceable transversely of the flexible pipe, wherein a displacement distance of the crossbeam corresponds at least approximately to the diameter of the flexible pipe, and wherein, when the crossbeam is displaced, the crossbeam traverses an area underneath the outlet opening and reduces the cross-section of the flexible pipe, tension springs having first ends each attached in an articulated manner to one of the two ends of the crossbeam and second ends fastened to the support frame, the tension springs being in a tensioned state when the crossbeam is located laterally of the outlet opening in a position releasing the flexible pipe, further comprising an adjusting member having a first end connected in an articulated manner to the crossbeam and a second end connected to the support frame, wherein the adjusting member is configured to move the crossbeam against a force of the tension springs, the improvement comprising the crossbeam having a length corresponding at least to the diameter of the flexible pipe the two ends of the crossbeam being suspended from the concrete container by connecting members, wherein the support frame comprises an open ring mounted underneath the outlet opening of the concrete container, wherein the second ends of the tension springs and of the adjusting member are attached to the open ring, wherein sections of the open ring which face each other are spaced apart by a distance which is at least equal to the diameter of the flexible pipe, and wherein the second ends of the tension springs are attached to the sections of the open ring which face each other.

2. The concrete container according to claim 1, wherein the connecting members are one of connecting rods, ropes and chains.

3. The concrete container according to claim 1, wherein the crossbeam comprises a shaft and roller members mounted freely rotatably on the shaft.

4. The concrete container according to claim 1, wherein the connecting members are connected to the container at fastening bolts arranged laterally offset in relation to a vertical diameter plane of the container.

* * * * *